US006880227B2

(12) United States Patent
Hasegawa

(10) Patent No.: US 6,880,227 B2
(45) Date of Patent: Apr. 19, 2005

(54) METHOD FOR MANUFACTURING NONRECIPROCAL CIRCUIT DEVICE, NONRECIPROCAL CIRCUIT DEVICE, AND COMMUNICATION APPARATUS INCORPORATING THE SAME

(75) Inventor: Takashi Hasegawa, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 638 days.

(21) Appl. No.: 10/026,511

(22) Filed: Dec. 19, 2001

(65) Prior Publication Data

US 2002/0089389 A1 Jul. 11, 2002

(30) Foreign Application Priority Data

Jan. 11, 2001 (JP) ..... 2001-004047

(51) Int. Cl.[7] ..... H01P 1/32; H01F 7/06

(52) U.S. Cl. ..... 29/592.1; 333/1.1; 333/24.2; 29/601

(58) Field of Search ..... 29/592.1, 600, 29/601, 602.1; 333/1.1, 24.2

(56) References Cited

U.S. PATENT DOCUMENTS

2002/0097104 A1 * 7/2002 Nakagawa et al. ..... 333/1.1

FOREIGN PATENT DOCUMENTS

| | | |
|---|---|---|
| JP | 6-196907 | 7/1994 |
| JP | 6-231947 | 8/1994 |
| JP | 07-283616 | 10/1995 |
| JP | 10041706 | 2/1998 |
| JP | 10-200307 | 7/1998 |
| JP | 10-327003 | 8/1998 |
| JP | 10242713 | 11/1998 |
| JP | 2000-114818 | 4/2000 |

* cited by examiner

*Primary Examiner*—Stephen E. Jones
(74) *Attorney, Agent, or Firm*—Keating & Bennett, LLP

(57) ABSTRACT

A highly reliable nonreciprocal circuit device can be easily manufactured at low cost. In the nonreciprocal circuit device, a resin layer is formed on the surface of a metal case. On a ferrite member, the terminals of central conductors are arranged with a predetermined angle therebetween. Inside a resin case including input/output terminals and ground terminals, there are arranged the ferrite member, the central conductors, a permanent magnet for applying a static magnetic field to the ferrite member and the central conductors, a resistor, and capacitors. The resin case is sandwiched by an upper yoke and a lower yoke. A resin layer formed of a thermosetting resin is arranged on each of the yokes. When the permanent magnet is thermally demagnetized, the thermosetting resin layer is hardened at the same time.

3 Claims, 9 Drawing Sheets

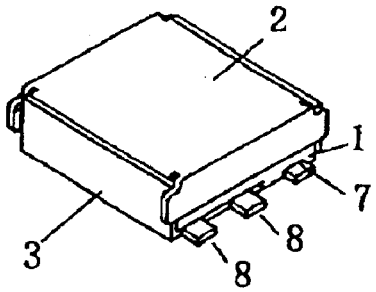
FIG. 2A
FIG. 2B
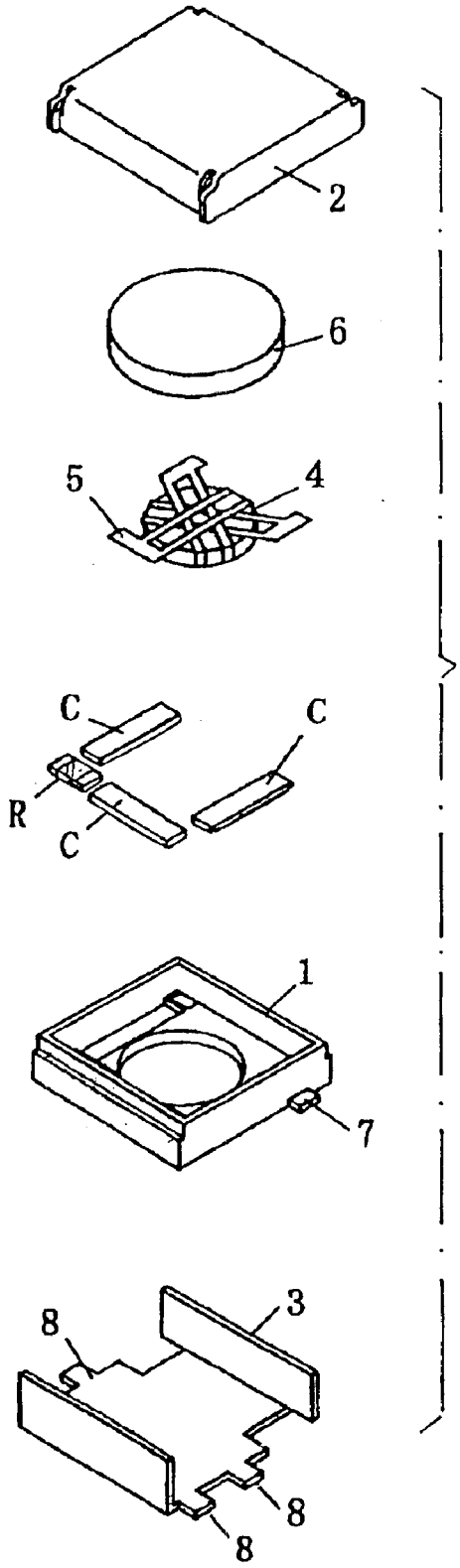

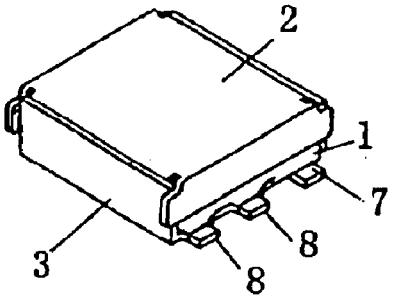
FIG. 5A
FIG. 5B
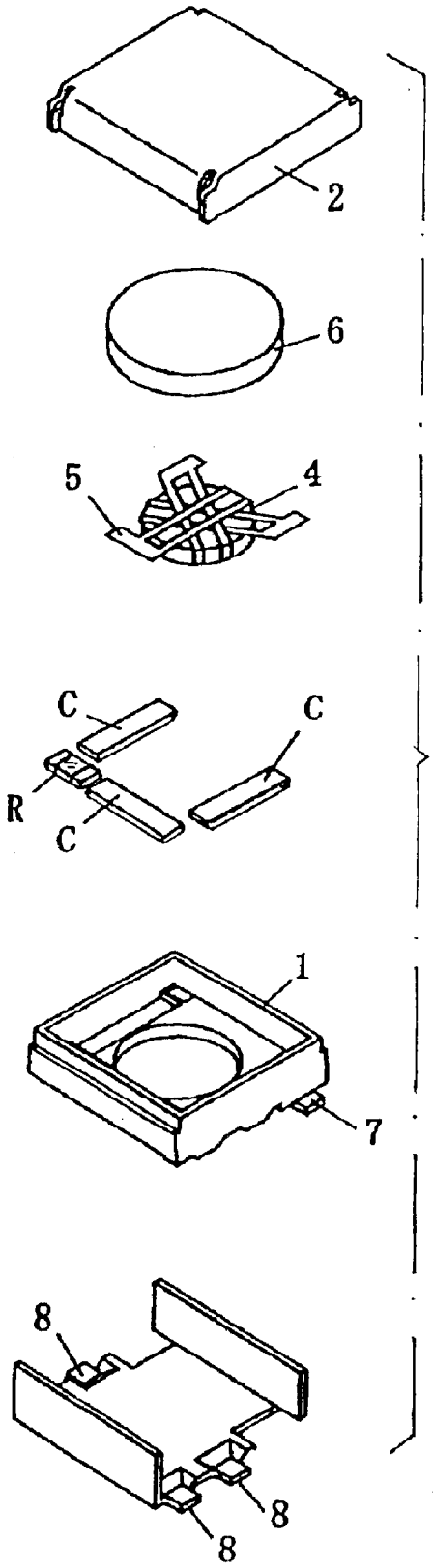

METHOD FOR MANUFACTURING NONRECIPROCAL CIRCUIT DEVICE, NONRECIPROCAL CIRCUIT DEVICE, AND COMMUNICATION APPARATUS INCORPORATING THE SAME

BACKGROUND OF THE INVENTION

1. Field of the Invention

The present invention relates to methods for manufacturing nonreciprocal circuit devices such as isolators and circulators used in microwave bands, nonreciprocal circuit devices manufactured by the methods, and communication apparatuses incorporating the nonreciprocal circuit devices.

2. Description of the Related Art

Known nonreciprocal circuit devices having the following structures have a resin material arranged in a metal case.

Japanese Unexamined Patent Application Publication No. 10-242713 describes a nonreciprocal circuit device in which a resin film is formed at parts other than the connecting portions of the bottom of a metal case.

In addition, Japanese Unexamined Patent Application Publication No. 10-41706 describes a nonreciprocal circuit device having a metal case composed of an upper part and a lower part which includes an insulative resin.

These nonreciprocal circuit devices have the following problems to be solved.

Referring to FIGS. 12 and 13, a description will be given of the process of manufacturing each of the nonreciprocal circuit devices described in the related art.

FIG. 12 is a flowchart of the first manufacturing process.

As shown in FIG. 12, a resin material is formed in advance on the metal case. The resin layer is not formed in the process of assembling the nonreciprocal circuit device. Thus, the cost of the metal case increases and therefore the entire cost of the product also increases.

On the other hand, the method shown in FIG. 13 includes a step of heating a nonreciprocal circuit device in the assembling process to slightly demagnetize (anneal) the magnet.

FIG. 13 is a flowchart showing the process of manufacturing the nonreciprocal circuit device including the heating step.

In this process, as shown in FIG. 13, the nonreciprocal circuit device is heated after being assembled to perform partial thermal demagnetization of the magnet. This arrangement can prevent the deterioration of characteristics due to thermal demagnetization after the device is manufactured and sold.

SUMMARY OF THE INVENTION

The present invention provides an improved method for manufacturing a nonreciprocal circuit device including a step of forming a resin layer on a surface of a metal case after other assembly steps have been performed. The invention further provides a nonreciprocal circuit device manufactured by the method of the invention and a communication apparatus incorporating the nonreciprocal circuit device.

According to a first aspect of the present invention, there is provided a method for manufacturing a nonreciprocal circuit device including a first step of forming a thermosetting resin layer on an outer surface of a metal case, after carrying out other assembly steps and adjusting the magnetic force of a permanent magnet, and a second step of heating the entire nonreciprocal circuit device to thermally demagnetize the permanent magnet and to harden the thermosetting resin layer simultaneously.

In this invention, the heating temperature may be set between 85 and 230° C.

According to a second aspect of the invention, there is provided a nonreciprocal circuit device including a metal case, central conductors, a ferrite member arranged near the central conductors, a permanent magnet for applying a static magnetic field to the ferrite core, and a thermosetting resin layer arranged on an outer surface of the metal case, the thermosetting resin layer being hardened by heating the entire nonreciprocal circuit device after adjusting the magnetic force of the permanent magnet.

In this nonreciprocal circuit device, a temperature at which the thermosetting resin layer is hardened may be set between 85 and 230° C.

In addition, in this invention, the thermosetting resin layer may be formed of a phenolic resin or an epoxy resin.

In addition, the nonreciprocal circuit device of the second aspect may further include ground terminals arranged on the metal case, and the thermosetting resin layer may be arranged on a portion of the bottom surface of the metal case spaced away from the ground terminals.

In addition, the ground terminals may protrude downward from the metal case.

In addition, the thermosetting resin layer may be arranged on the top surface of the metal case.

In the nonreciprocal circuit device, the metal case may include upper and lower yokes and the thermosetting resin may be arranged partially or entirely at the areas where the two yokes are bonded to each other.

In addition, the areas where the yokes may be bonded to each other may be partially soldered.

In addition, the metal case and the resin layer may have contrasting colors. For example, the surface of the metal case may be metal-plated and the color of the thermosetting resin layer may be black.

According to a third aspect of the invention, there is provided a communication apparatus incorporating the nonreciprocal circuit device of the invention.

Other features and advantages of the present invention will become apparent from the following description of the embodiments of invention which refers to the accompanying drawings.

BRIEF DESCRIPTION OF THE DRAWINGS

FIGS. 2A and 2B show an external perspective view and an exploded perspective view of a nonreciprocal circuit device according to a second embodiment of the invention.

FIGS. 5A and 5B show an external perspective view and an exploded perspective view of a nonreciprocal circuit device according to a third embodiment of the invention.

DESCRIPTION OF EMBODIMENTS OF THE INVENTION

Figure 1:
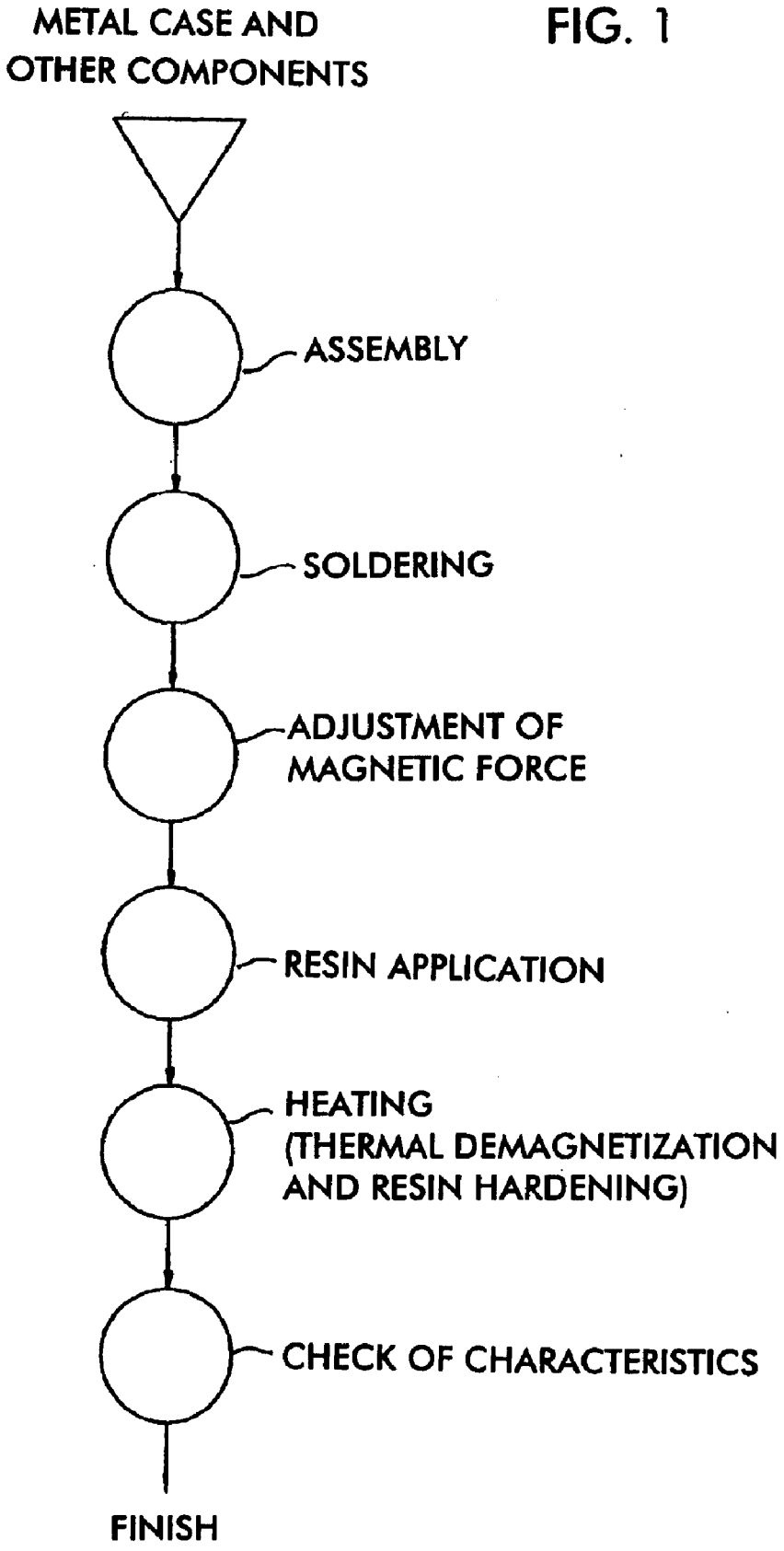
FIG. 1 is a flowchart showing a method for manufacturing a nonreciprocal circuit device according to a first embodiment of the present invention.

Referring to FIG. 1, a description will be given of a nonreciprocal circuit device according to a first embodiment of the present invention and the method for manufacturing the nonreciprocal circuit device.

FIG. 1 shows a flowchart showing a method for manufacturing the nonreciprocal circuit device.

As shown in FIG. 1, the assembly of all components forming the nonreciprocal circuit device, which include a metal case, is completed in an assembly process, and then the electrical and mechanical junctions of the components are soldered to finish the entire structure. After that, the magnetic force of a magnet is adjusted, and then, a thermosetting resin is applied on an outer surface of the metal case. Next, heat is applied to thermally demagnetize (anneal) the magnet and harden the resin at the same time.

Examples of heating methods for heating the structure in this situation include, for example, a batch-type heating method in which the structure is left in a thermostatic oven for 15 minutes at a temperature of 120° C., and a sheet-type heating method using a reflow furnace.

In addition, the resin may be applied before adjusting the magnetic force. However, immediately after the application, the resin needs to be temporarily hardened. Otherwise, the resin will flow out and adhere unnecessarily to other parts and to manufacturing machinery.

A communication apparatus incorporating the nonreciprocal circuit device is desirably usable at a temperature between −35 and 85° C. Thus, in order to prevent characteristic deterioration of the nonreciprocal circuit device due to thermal demagnetization of the magnet after being incorporated in the communication apparatus, the nonreciprocal circuit device is heated in advance at 85° C. or higher.

Solder used for solder bonding is a high-temperature solder which melts at 230° C. or higher. Thus, if the resin hardening temperature is set to be lower than 230° C., then solder applied at parts where the central conductors are bonded to capacitors, input/output terminals, and the like do not melt again due to heating from the resin hardening.

Consequently, the temperature of heat applied for hardening the resin and thermally demagnetizing the magnet is set between 85 and 230° C.

As a result, since the step of heating the resin and the step of thermally demagnetizing the magnet can be simultaneously performed, the number of steps can be reduced.

Next, referring to FIGS. 2A and 2B, FIG. 3, and FIG. 4, a description will be given of the structure of a nonreciprocal circuit device according to a second embodiment of the invention.

FIG. 2A shows an external perspective view of the nonreciprocal circuit device and FIG. 2B shows an exploded perspective view thereof.

Figure 3:
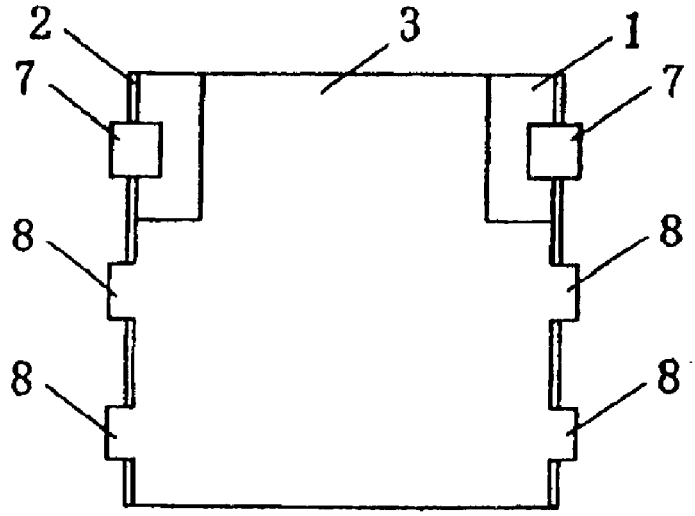
FIG. 3 is a bottom view of the nonreciprocal circuit device according to the second embodiment.
Figure 4:
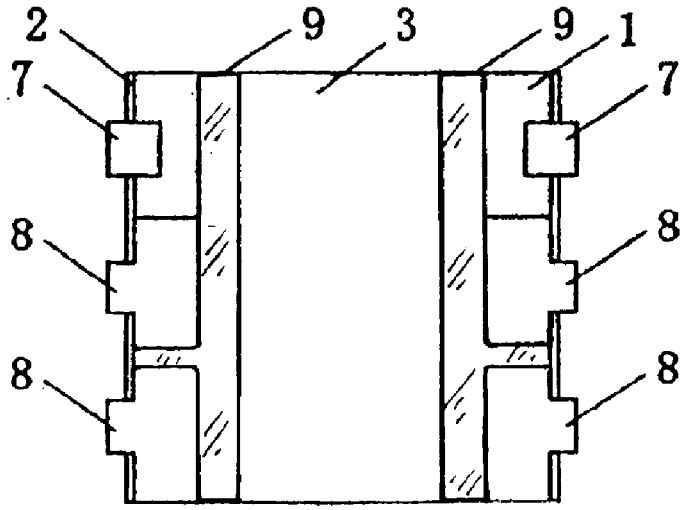
FIG. 4 is another bottom view of the nonreciprocal circuit device according to the second embodiment.

FIG. 3 shows a bottom view of the nonreciprocal circuit device after the adjustment of a magnetic force. FIG. 4 shows a bottom view of the nonreciprocal circuit device after resin is applied thereon.

In these figures, there are shown a resin case 1, an upper yoke 2, a lower yoke 3, a ferrite member 4, central conductors 5, a permanent magnet 6, input/output terminals 7, ground terminals 8, thermosetting resin 9, a resistor R, and capacitors C.

The terminals of the central conductors 5 are arranged at a predetermined angle therebetween on the ferrite member 4. The resin case 1 having the input/output terminals 7 contains the ferrite member 4, the central conductors 5, the permanent magnet applying a static magnetic field to the ferrite member 4 and the central conductors 5, the resistor R, and the capacitor C. Then, in a manner enclosing the resin case 1, the upper yoke 2 and the lower yoke 3 having the ground terminals 8 sandwich the entire resin case 1 from above and below to constitute the nonreciprocal circuit device.

As shown in each of FIGS. 3 and 4, on the bottom surface of the lower yoke 3, the thermosetting resin is applied and hardened to prevent the terminals from being short-circuited to each other due to a solder bridge. The nonreciprocal circuit device according to the present invention uses thermosetting resin hardened at a temperature between 85 and 230° C. For example, the thermosetting resin is a phenolic resin, an epoxy resin, or the like.

With the above arrangement, the nonreciprocal circuit device can be manufactured through the process described in the first embodiment.

In addition, the color of the resin used is selected to have a good contrast with the color of the case. Specifically, the upper yoke 2 and the lower yoke 3 are metal-plated, for example, with Ni, Ag, or the like. Thus, in order to obtain good contrast, the color of the resin may be black. As a result, defects in the thermosetting resin, such as application failures, can be easily detected.

It is only necessary for the thermosetting resin applied on the bottom of the lower yoke 3 to be arranged in a manner surrounding the terminals. Thus, the resin does not have to be applied on the entire bottom surface and needs only to be applied on parts of the bottom surface spaced away from the parts where the terminals are arranged. As a result, short-circuiting between the terminals due to soldering can be prevented.

In addition, when the solder-bonded parts are partially restricted, a self-alignment function works when mounting the nonreciprocal circuit device on a substrate or the like and thereby positional precision for mounting the device can be improved. Accordingly, open/short-circuiting due to positional deviations of the nonreciprocal circuit device can be prevented, so that the reliability of the communication apparatus can be increased.

Next, referring to FIGS. 5A, 5B, 6A and 6B, a description will be given of the structure of a nonreciprocal circuit device according to a third embodiment of the present invention.

FIG. 5A shows an external perspective view of the nonreciprocal circuit device and FIG. 5B shows an exploded perspective view thereof.

In each of FIGS. 5A and 5B, there are shown a resin case 1, an upper yoke 2, a lower yoke 3, a ferrite member 4, central conductors 5, a permanent magnet 6, an input/output terminal 7, a ground terminal 8, thermosetting resin 9, a resistor R, and a capacitor C.

Figure 6A:
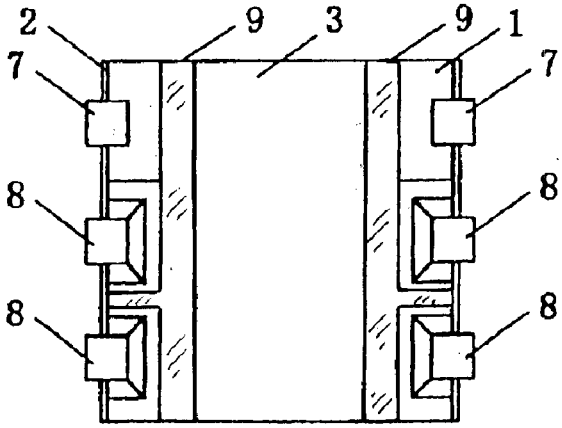
FIGS. 6A and 6B show a bottom view and a front view of a nonreciprocal circuit device according to the third embodiment of the invention.
Figure 6B:
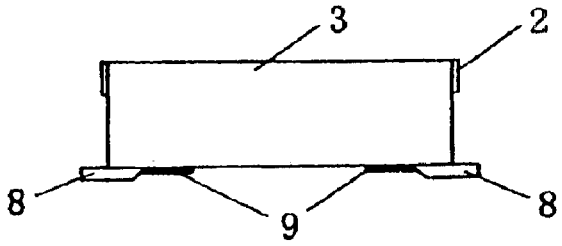

As shown in FIGS. 6A and 6B, predetermined parts of the ground terminals 8 included in the lower yoke 3 protrude downward and laterally from the bottom surface. The height of the parts protruding in the bottom direction is larger than the thickness of the resin. Specifically, if the thickness of the resin is set to be 30 $\mu$m or less, the height of the protruding parts in the downward direction is set to be over 30 $\mu$m. However, when the protruding parts are too high, the height of the device increases. Thus, the height of the protruding parts is set to be 100 $\mu$m or less.

In addition, like the ground terminals 8, the input/output terminals 7 are extended downward so that the input/output terminals 7 are maintained flush with the ground terminals 8.

With this arrangement, since the resin part does not extend in a direction lower than the terminals of the nonreciprocal circuit device, when the device is bonded onto a substrate, an open circuit between the bonding part and the substrate can be prevented.

Next, referring to FIG. 7, a description will be given of a nonreciprocal circuit device according to a fourth embodiment of the present invention.

Figure 7:
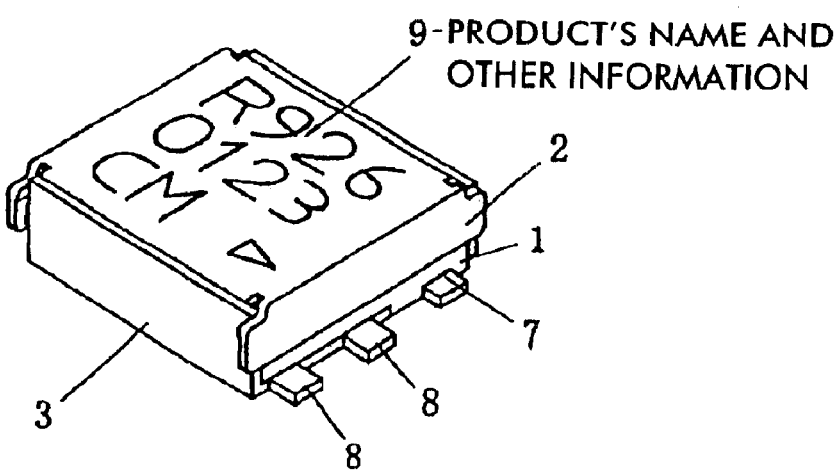
FIG. 7 is an external perspective view of a nonreciprocal circuit device according to a fourth embodiment of the invention.

FIG. 7 is an external perspective view of the nonreciprocal circuit device.

In FIG. 7, there are shown a resin case 1, an upper yoke 2, a lower yoke 3, an input/output terminal 7, a ground terminal 8, and thermosetting resin 9.

The nonreciprocal circuit device shown in FIG. 7 is the equivalent of the nonreciprocal circuit device according to the first embodiment. In this case, letters and marks are printed with thermosetting resin 9 on the top surface of the upper yoke.

With this arrangement, information such as the name of the product, the lot number, and the position of an input/output port can be inscribed on the nonreciprocal circuit device. Thus, poor packaging and mounting in a wrong direction can be prevented, and when defects are detected in a later step, a target lot can be easily identified and therefore work efficiency regarding screening of the target lot and the like can be improved. As a result, since the entire production cost is reduced, a low-priced nonreciprocal circuit device can be manufactured.

The inscribed information about the position of the input/output terminal is particularly useful when it is difficult to discriminate between the ground terminal and the input/output terminal from above.

Next, referring to FIGS. 8 and 9, a description will be given of the structure of a nonreciprocal circuit device according to a fifth embodiment of the present invention.

Figure 8:
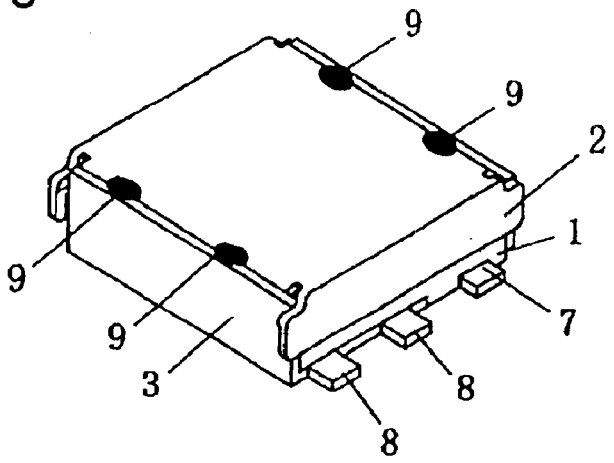
FIG. 8 is an external perspective view of a nonreciprocal circuit device according to a fifth embodiment of the invention.

FIG. 8 is an external perspective view of the nonreciprocal circuit device.

Figure 9:
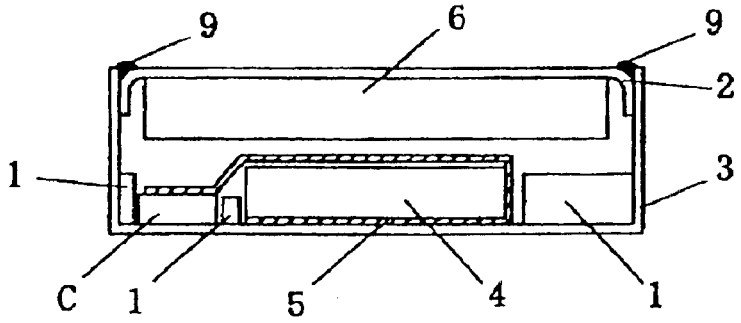
FIG. 9 is a sectionalized side view of the nonreciprocal circuit device according to the fifth embodiment.

FIG. 9 is a sectional view of the nonreciprocal circuit device.

In each of FIGS. 8 and 9, there are shown a resin case 1, an upper yoke 2, a lower yoke 3, a ferrite member 4, central conductors 5, a permanent magnet 6, an input/output terminal 7, a ground terminal 8, and thermosetting resin 9.

The nonreciprocal circuit device shown in FIG. 8 is the equivalent of the nonreciprocal circuit device according to the first embodiment. In this case, the thermosetting resin is applied at the parts where the upper yoke 2 is bonded to the lower yoke 3 and the resin is hardened.

With this arrangement, the following problems will be resolved.

Conventionally, the upper yoke and the lower yoke are solder-bonded to each other while pressing the upper yoke in order to prevent open circuits at the parts where the central conductors are connected to the capacitors and the input/output terminals. Thus, when the solder is melted again due to heating when mounting the device or other reasons, the upper yoke is likely to float due to stress from the inside. When the upper yoke floats, the inductances of the central conductors increase and the resonant frequency of the nonreciprocal circuit device becomes lower. Consequently, desired characteristics cannot be obtained. In addition, as the worst case, the parts where the central conductors are connected with the capacitors and the input/output terminals can be disconnected. On the other hand, when solder bonding is performed without pressing the upper yoke, if re-melting of the solder occurs later, the upper yoke can sink due to its own weight. As a result, the inductances of the central conductors decrease and the resonant frequency of the nonreciprocal circuit device becomes higher. Thus, desired characteristics cannot be obtained.

Accordingly, as shown in FIG. 8, the upper yoke 2 is bonded to the lower yoke 3 with a thermosetting resin 9. Thus, movement between the upper and lower yokes due to heating can be prevented. Thus, characteristic changes and disconnection can be prevented.

Next, referring to FIG. 10, a description will be given of a nonreciprocal circuit device according to a sixth embodiment of the invention.

Figure 10:
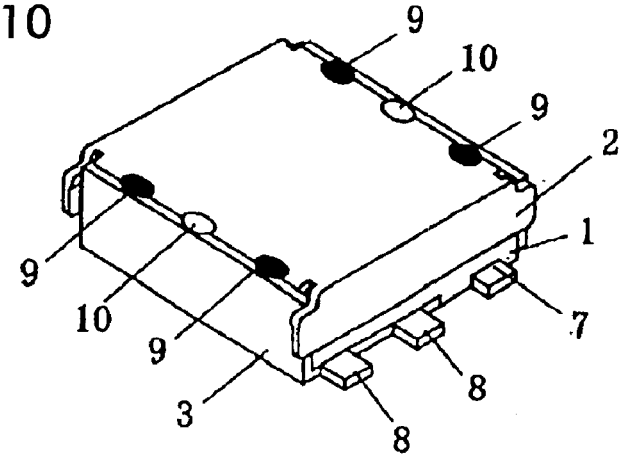
FIG. 10 is an external perspective view of a nonreciprocal circuit device according to a sixth embodiment of the invention.

FIG. 10 is an external perspective view of the nonreciprocal circuit device.

In FIG. 10, there are shown a resin case 1, an upper yoke 2, a lower yoke 3, an input/output terminal 7, a ground terminal 8, thermosetting resin 9, and solder 10.

The nonreciprocal circuit device shown in FIG. 10 is the equivalent of the nonreciprocal circuit device according to the fifth embodiment. In this case, the solder 10 is applied at the parts where the upper yoke 2 is bonded to the lower yoke 3.

With the above arrangement, when compared with the case in which only resin is used, the strength of bonding in the temperature range used increases and therefore a highly reliable nonreciprocal circuit device can be manufactured.

Figure 11:
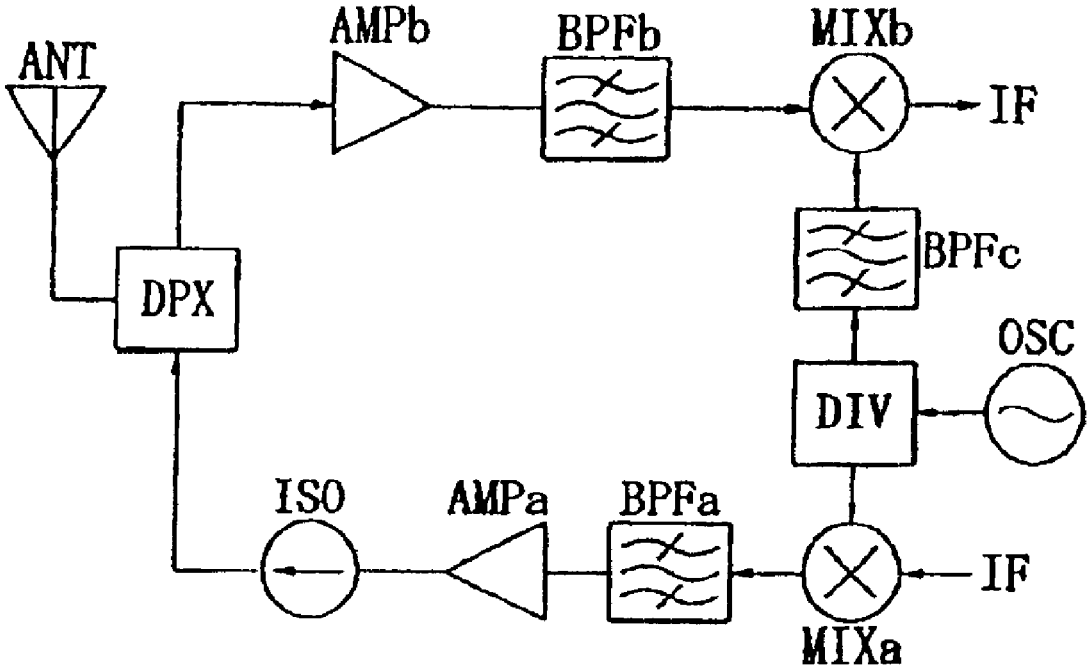
FIG. 11 is a block diagram of a communication apparatus according to a seventh embodiment of the invention.
Figure 12:
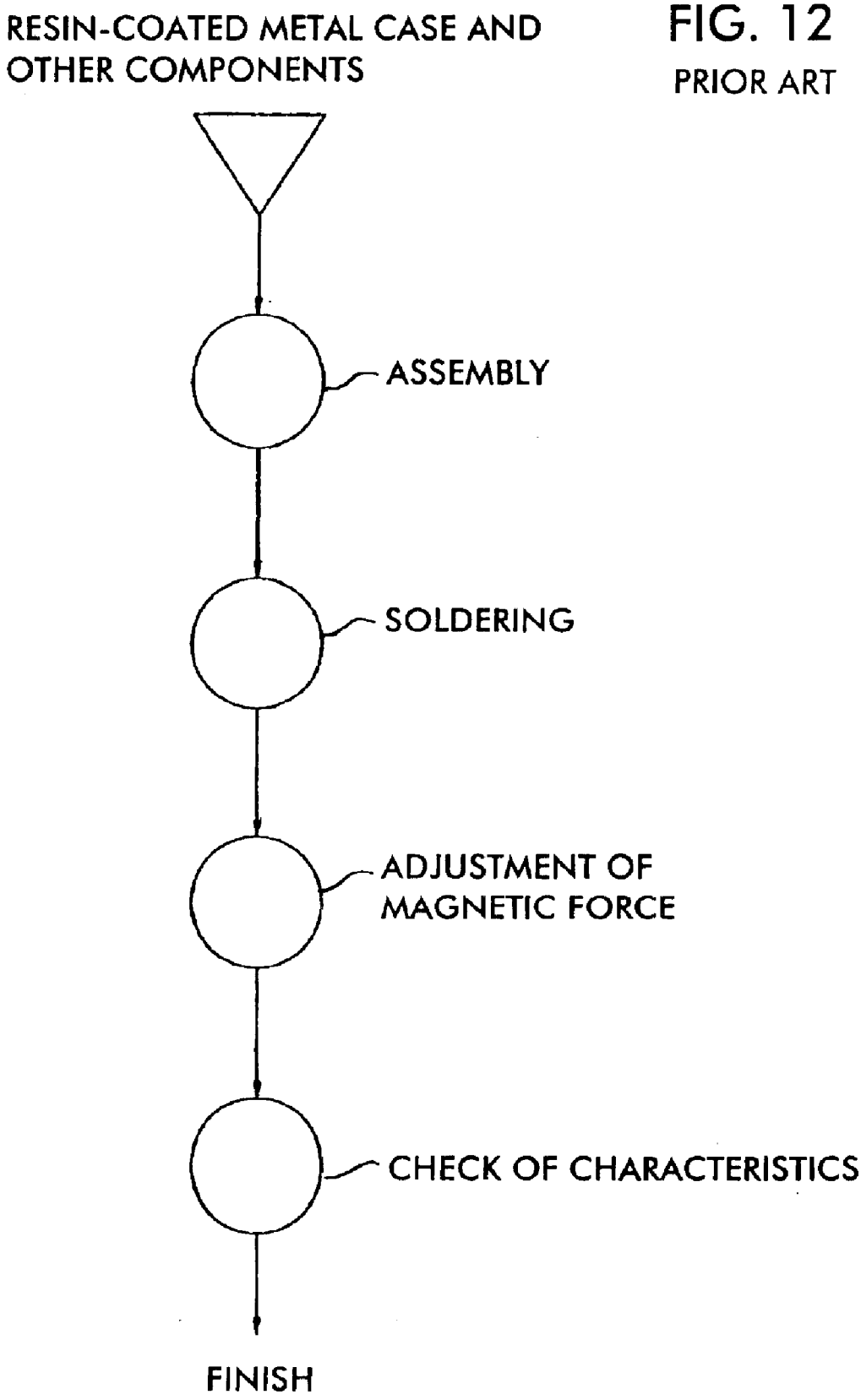
FIG. 12 PRIOR ART
FIG. 12 is a flowchart showing a method for manufacturing a nonreciprocal circuit device of the related art.
Figure 13:
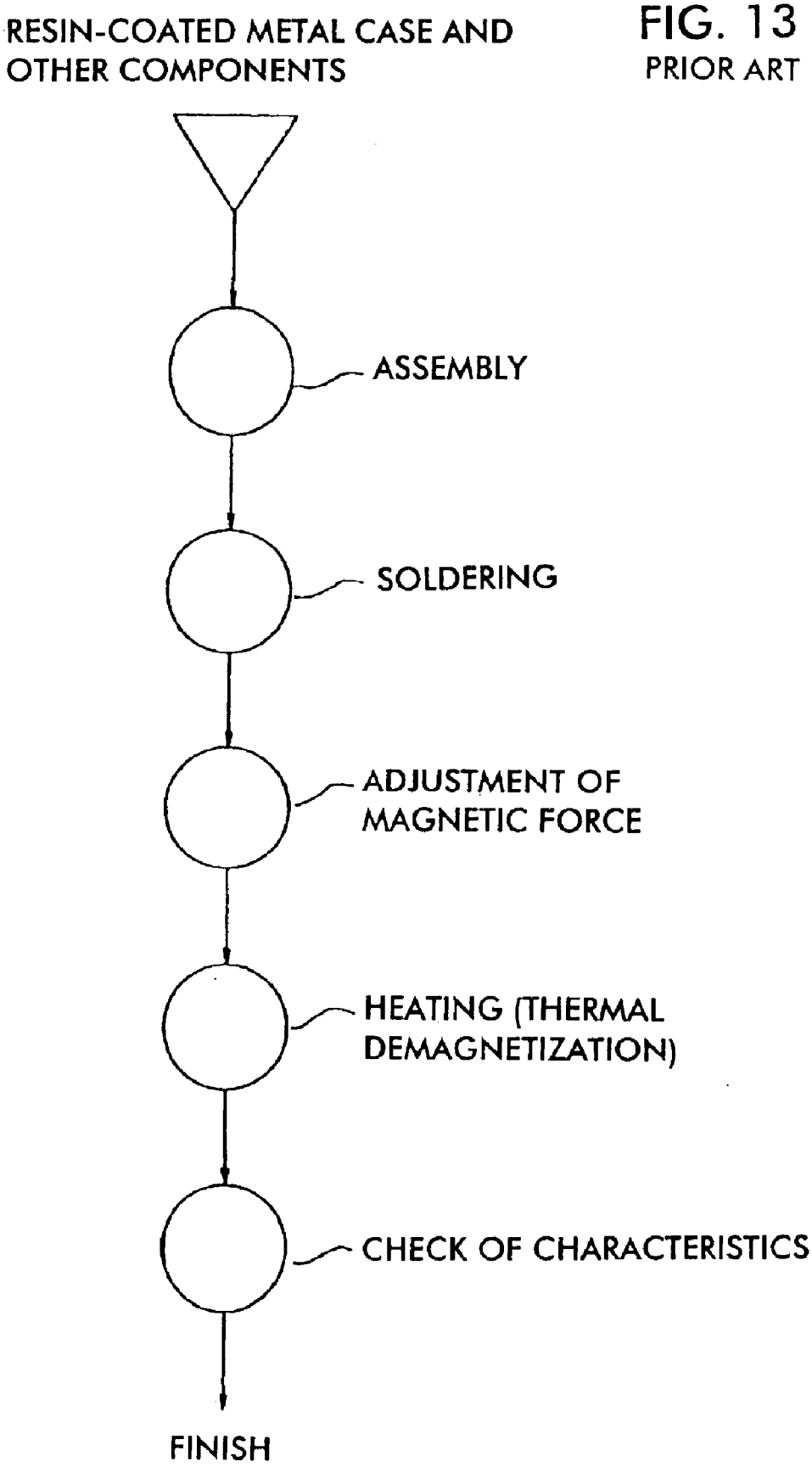
FIG. 13 PRIOR ART
FIG. 13 is a flowchart showing a method for manufacturing another nonreciprocal circuit device of the related art.

Next, referring to FIG. 11, a description will be given of a communication apparatus according to a seventh embodiment of the present invention. In FIG. 11, there are shown a transmission/reception antenna ANT, a duplexer DPX, band pass filters BPFa and BPFb, amplifying circuits AMPa and AMPb, mixers MIXa and MIXb, an oscillator OSC, a divider DIV, and an isolator ISO.

The mixer MIXa mixes an input IF signal with a signal output from the divider DIV. The filter BPFa passes only the signals of a transmission frequency band among the signals mixed and outputed by the mixer MIXa, and the amplifier AMPa power-amplifies the signals, which are transmitted via the isolator ISO and the duplexer DPX from the antenna ANT. The isolator ISO blocks signals reflected to the amplifier AMPa from the duplexer DPX and the like and prevents the occurrence of distortion in the amplifier AMPa. The amplifier AMPb amplifies a reception signal obtained from the duplexer DPX. The filter BPFb passes only the signals of a reception frequency band among reception signals output from the amplifier AMPb. The mixer MIXb mixes a frequency signal output from the divider DIV via the filter BPFc with the reception signal to output an intermediate frequency signal IF.

The isolator shown in FIG. 11 is the isolator used in any one of the second to sixth embodiments.

In this manner, with the use of the isolator having reduced insertion loss, size, and weight, there can be provided a thin and lightweight communication apparatus, such as a mobile phone, having entirely high power efficiency.

As described above, according to the present invention, the method for manufacturing the nonreciprocal circuit device includes the step of hardening the thermosetting resin arranged on the metal case of the nonreciprocal circuit device after the adjustment of the magnetic force. This method enables easy manufacturing of the nonreciprocal circuit device at low cost.

In addition, the temperature of heat for hardening is set between 85 and 230° C. While thermally demagnetizing the magnet in advance, the resin can be hardened without causing remelting of solder.

In addition, when the thermosetting resin is formed of a phenolic resin or an epoxy resin, the resin can be hardened at a temperature set between 85 and 230° C. As a result, the nonreciprocal circuit device having good characteristics and high reliability can be easily manufactured at low cost.

In addition, the ground terminals may be formed on the metal case, and on the bottom surface of the metal case spaced away from the ground terminal, there is arranged thermosetting resin hardened via the previous step. As a result, electrical defects generated between terminals can be reduced, and a highly reliable nonreciprocal circuit device can be manufactured.

In addition, the ground terminals of the metal case may be extended downward from the bottom surface. With this arrangement, electrical defects between the terminals can be reduced and therefore the nonreciprocal circuit device can obtain high reliability.

Furthermore, by arranging the thermosetting resin on the top surface of the metal case, information can be inscribed on the device. Thus, this enables easy handling of the nonreciprocal circuit device.

Furthermore, the thermosetting resin may be applied partially or entirely at the areas where the upper and lower yokes are bonded to each other. As a result, since the occurrence of defects due to the re-melting of solder can be suppressed, the nonreciprocal circuit device can obtain high reliability.

In addition, when solder bonding is performed partially at the areas where the two yokes are bonded to each other, the strength of bonding can be increased under circumstances in which the device is used. The nonreciprocal circuit device can obtain high reliability.

In addition, the surfaces of the metal case may be metal-plated and the color of the thermosetting resin may be black. With this arrangement, defects in resin application can be easily detected and the nonreciprocal circuit device can be easily handled.

Furthermore, with the use of the nonreciprocal circuit device, the communication apparatus of the present invention can have high reliability, low loss, and good characteristics and can be manufactured at low cost.

While embodiments of the present invention have been described above, variations thereto will occur to those skilled in the art within the scope of the present inventive concepts, which are delineated by the following claims.

What is claimed is:

1. A method for manufacturing a nonreciprocal circuit device including a metal case containing central conductors, a ferrite core near the central conductors, and a permanent magnet for applying a static magnetic field to the ferrite core, the method comprising the steps of:

forming a thermosetting resin layer on an outer surface of the metal case; and heating the entire nonreciprocal circuit device after adjusting the magnetic force of the permanent magnet to simultaneously thermally demagnetize the permanent magnet and harden the thermosetting resin layer.

2. The method for manufacturing a nonreciprocal circuit device according to claim 1, wherein the heating temperature is set between 85 and 230° C.

3. The method for manufacturing a nonreciprocal circuit device according to claim 2, wherein said device comprises a high-temperature solder which melts at 230° C. or higher.

* * * * *